United States Patent [19]

Yokoyama et al.

[11] Patent Number: 4,703,294

[45] Date of Patent: Oct. 27, 1987

[54] REMOTELY CONTROLLABLE RELAY

[75] Inventors: Yoichi Yokoyama; Hiroaki Hamaguchi, both of Kadoma; Masatoshi Yamamoto, Tsu, all of Japan

[73] Assignee: Matsushita Electric Works, Ltd., Japan

[21] Appl. No.: 808,648

[22] Filed: Dec. 13, 1985

[30] Foreign Application Priority Data

Dec. 24, 1984 [JP] Japan ..... 59-278584
Dec. 25, 1984 [JP] Japan ..... 59-275932

[51] Int. Cl.[4] ..... H01H 67/02

[52] U.S. Cl. ..... 335/121; 335/6; 335/176

[58] Field of Search ..... 335/121, 131–132, 335/133, 136–137, 192–195, 189–190, 176, 6, 13; 200/147 R

[56] References Cited

U.S. PATENT DOCUMENTS 2,622,164 12/1952 Cataldo ..... 335/190
3,707,691 12/1972 Minks ..... 335/192
4,400,670 8/1983 Mostosi ..... 335/189 X
4,509,026 2/1985 Matsushita ..... 335/132 X
4,604,596 8/1986 Yokoyama et al. ..... 335/14

FOREIGN PATENT DOCUMENTS 1963639 6/1971 Fed. Rep. of Germany ..... 335/132
685711 3/1965 Italy .

*Primary Examiner*—Arthur T. Grimley
*Assistant Examiner*—Jane K. Lau
*Attorney, Agent, or Firm*—Stevens, Davis, Miller & Mosher

[57] ABSTRACT

A remotely controllable relay comprises a rocker pivoted at an intermediate point for rocking at one end in normal or reverse direction in response to forward or backward motion of a movable member of an electromagnet means, and a movable contactor linked to the rocker for contacting with or separating from a fixed contactor in response to the rocking of the rocker. A larger momentum at the other end remote from the pivoted point of the rocker achieved with a smaller momentum of the movable member is utilized to sufficiently separate the movable contactor from the fixed contactor upon contact opening, the smaller momentum movable member allowing the electromagnet means to be minimized in size for a miniaturization of the relay and consumed power saving.

6 Claims, 16 Drawing Figures

REMOTELY CONTROLLABLE RELAY

TECHNICAL BACKGROUND OF THE INVENTION

This invention relates to remotely controllable relays and, more specifically, to a relay which can be connected to various types of loads to turn ON and OFF an associated power source circuit forthe loads in response to ON and OFF signals from a remote control switch.

The remotely controllable relays of the type referred to are useful at turning ON and OFF the power source circuit for a plurality of loads respectively at different places under control of a plurality of remote control switches electrically connected to the relays, performing a centralized control of such loads to each of which the respective relays are connected as collectively installed at a single place, and the like purposes.

DISCLOSURE OF PRIOR ART

Suggested, for example, in Japanese Patent Appln. Laid-Open Publication No. 60-97527 by T. Iio et al is an example of the remotely controllable relays of the above kind, in which an electromagnet means of a DC automation type is disposed within in casing and has a moveable core with which a moveable member is integralized for linear motion in axial directionn of a coil of the electromagnet means, and a moveable contactor is secured to this moveable member to be shiftable with its linear motion, so that either a normal or reverse directional current fed to the electromagnet means will cause the movable member to be moved forward or backward in the axial direction of the coil and the movable contactor to contact with or separate from a fixed contactor. For the electromagnet means appliable to the remotely controllable relays of this kind, a reference should be made to, for example, U.S. Pat. No. 3,747,035 to I. Morimoto et al.

In such known remotely controllable relay as above, however, there arises a risk that, unless the linear motion of the movable member upon which the shift of the movable contactor relies is made sufficiently large in the stroke, the movable contactor cannot be reliably separated from the fixed contactor. When, on the other hand, the linear motion stroke is made sufficiently large, a relatively larger space will be required for such motion to have a relay casing enlarged, which has been a drawback for the relays of the kind referred to a miniaturization of which has been a common demand. Yet, a reduction to a possible extent of required current feed amount to the electromagnet means has been desired for saving power consumption because such power saving contributes to the miniaturization of the electromagnet means and hence of the entire relay. However, all known relays of the remotely controllable type have been in lack of any measure for these demands.

TECHNICAL FIELD OF THE INVENTION

A primary object of the present invention is, therefore, to provide a remotely controllable relay which can achieve a sufficiently large separating motion of the movable contactor even with a relatively small shifting amount of the movable member of electromagnet means, so as to be effectively contributive to the relay miniaturization and consumed power saving.

According to the present invention, this object can be realized by providing a remotely controllable relay wherein a movable member is coupled to a movable core of an electromagnet means a current fed to which is reversible for forward and backward motion of the core along the axis of a coil of the means, and a movable contactor is linked to the movable member for contacting with and separating from a fixed contactor, the both contactors being connected to a load, the movable member being shifted in one direction of the coil axis in response to the current fed in one direction to the electromagnet means to thereby turn ON or OFF a power source circuit to the load, wherein a rocker is linked to the movable member for rocking in normal or reverse direction in response to the shifting direction of the movable member, and the movable contactor is linked to the rocker for the contacting or separating operation with respect to the fixed contactor in response to the rocking direction of the rocker.

Accordingly, in the present invention, the rocker linked to the movable member is made to attain a larger momentum at one end remote from pivot point of the rocker even with a relatively small momentum of the movable member, whereby the movable contactor linked to the rocker is also made to be shiftable to a larger extent with respect to the fixed contactor, so that required shifting space for the rocker can be minimized for allowing a smaller electromagnet means to be utilizable to render the miniaturization of the remotely controllable relay to be possible, while the small momentum of the movable member in the electromagnet means contributes to the consumed power saving.

Other objects and advantages of the present invention shall be made clear in the following description of the invention detailed with reference to preferred embodiments shown in accompanying drawings.

Figure 1:
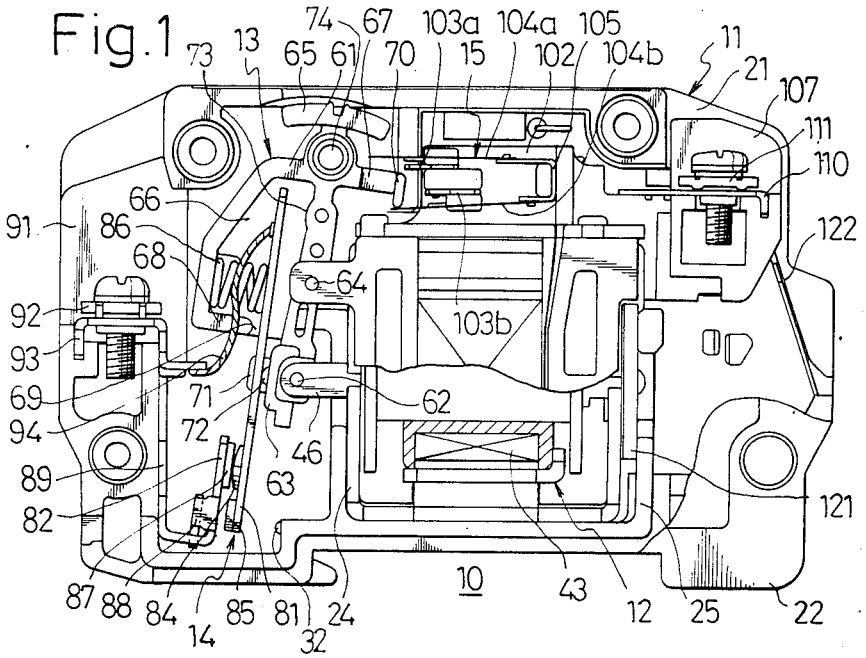
FIG. 1 is a side elevation in an embodiment of the remotely controllable relay according to the present invention, with most part of a covering for a casing removed on one side wall and with a part of the electromagnet means also removed, for showing the interior structure in contact closing state.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Referring to FIGS. 1 to 7, the remotely controllable relay 10 according to the present invention generally comprises a casing 11 for housing all other constituents, an electromagnet means 12, a switching-contact operating means 13 partly pivot-connected to the electromagnet means 12, a main switching contact means 14 and an auxiliary switching contact means 15, both of which contact means are linked to the operation means 13.

Figure 3:
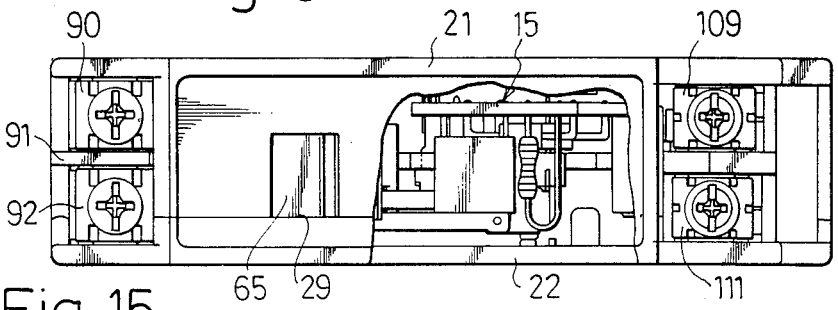
FIG. 3 is a top plan view of the relay of FIG. 1 with a part of casing removed.
Figure 5:
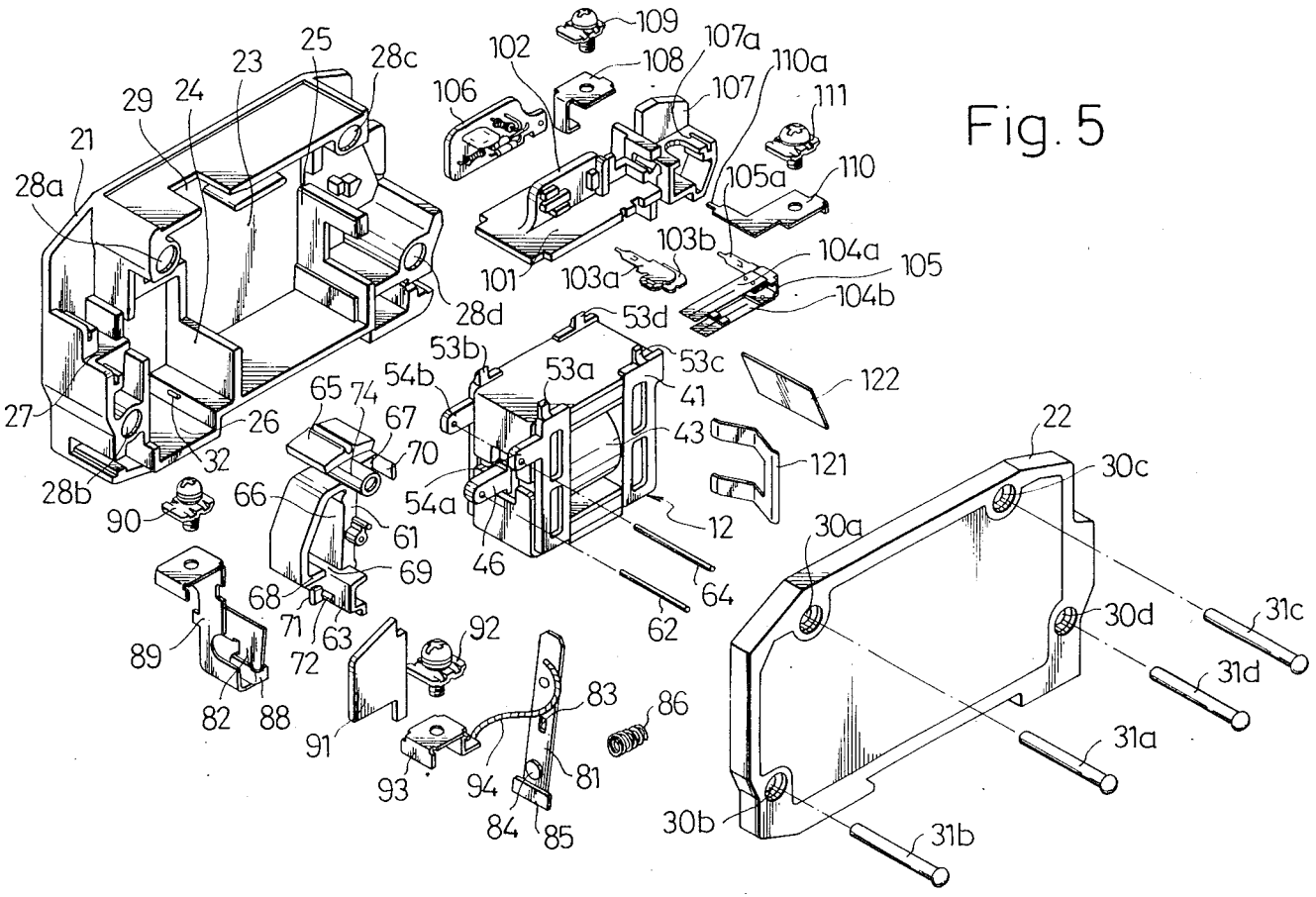
FIG. 5 is a perspective view of the relay of FIG. 1 with respective parts thereof shown as disassembled.

Referring more specifically to FIGS. 3 and 5, the casing 11 comprises a body 21 and a covering 22. The body 21 is substantially box-shaped and has therein a larger central compartment 23 defined by a pair of parallelly opposed partitions 24 and 25, a smaller compartment 26 on outer side of the partition 24, and a terminal mounting part 27 on further outer end side and partly opened endwise, while a space on outer side of the other partition 25 is substantially fully opened at the other end of the body. Four coupling holes 28*a* through 28*d* are provided in the body 21 at upper and lower positions adjacent the both ends, and an indicating aperture 29 is made in the upper peripheral wall of the body. On the other hand, the covering 22 is formed generally in a plate-shape having holes 30*a* to 30*d* at positions coinciding with the coupling holes 28*a* to 28*d* of the body 21 so that the covering 22 may be coupled to the body 21 by means of pins 31*a* to 31*d* inserted through these holes 30*a* to 30*d* and screwed into the holes 28*a* to 28*d* of the body, the holes being matched with each other with the covering 22 fitted over the body 21.

Figure 6:
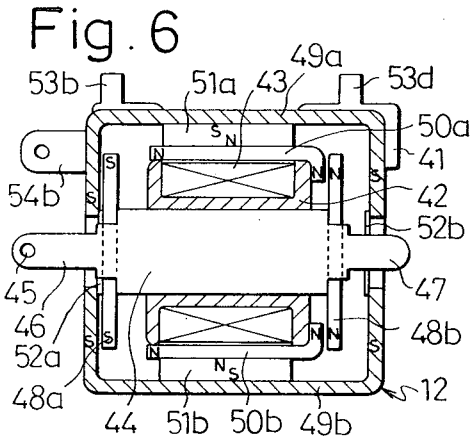
FIG. 6 is a vertical sectional view of the electromagnet means in the relay of FIG. 1, wherein a movable core is shown at its forward shifted position.
Figure 7:
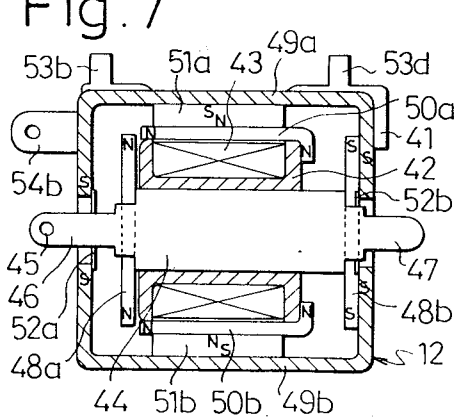
FIG. 7 is a view similar to FIG. 6 with the movable core shown at its backward shifted position.

The electromagnet means 12 is of a type operated by a direct current and is removably housed within the larger compartment 23, leaving a small space between the top face of the means 12 and the top peripheral wall of the body 21. As seen in FIGS. 5 to 7, the electromagnet means 12 includes a coil frame 41, a coil bobbin 42 disposed in the center of the frame, a coil 43 wound on the bobbin for feeding thereto a current alternately in opposite directions, and a movable core 44 disposed on the axis of the bobbin 42 for reciprocal forward and backward movement in the axial direction of the coil. The movable core 44 functions as a plunger, and is thus formed to have, at the forward side longitudinal end, a movable projection 46 having a pivot hole 45 and, at the backward end, a pushing projection 47, while a pair of plate-shaped armatures 48*a* and 48*b* are fitted respectively to each base portion of the both projections 46 and 47 to be parallel to each other as disposed on both axial outer sides of the bobbin 42.

Further in the electromagnet means 12, a pair of U-shaped yokes 49*a* and 49*b* are embraced by the coil frame 41 as opposed to each other to enclose the coil assembly of the bobbin 42, coil 43 and movable core 44 in their axial direction, leaving clearances around the assembly so that, between the coil 43 and the respective yokes 49*a* and 49*b*, smaller yokes 50*a* and 50*b* and permanent magnets 51*a* and 51*b* are disposed, while allowing the both end projections 46 and 47 of the core 44 to extend through gaps between opposed ends of leg portions of the U-shaped yokes 49*a* and 49*b*. The smaller yokes 50*a* and 50*b* are extended edgewise to the axial end faces of the bobbin 42 for close approach to the smaller yokes of the armatures 48*a* and 48*b* upon their forward and backward movements with the movable core 44. For this purpose, in particular, the smaller yokes 50*a* and 50*b* are longer extended and bent into L-shape at backward side edge to ride on the same side end face of the bobbin 42. Further, residual plate members 52*a* and 52*b* provided at the gaps of the yokes 49*a* and 49*b* to be inside thereof. The coil frame 41 is provided at the top with upward projections 53*a* to 53*d* and at forward side upper portions with horizontal projections 54*a* and 54*b* having respectively a pin hole.

Figure 2:
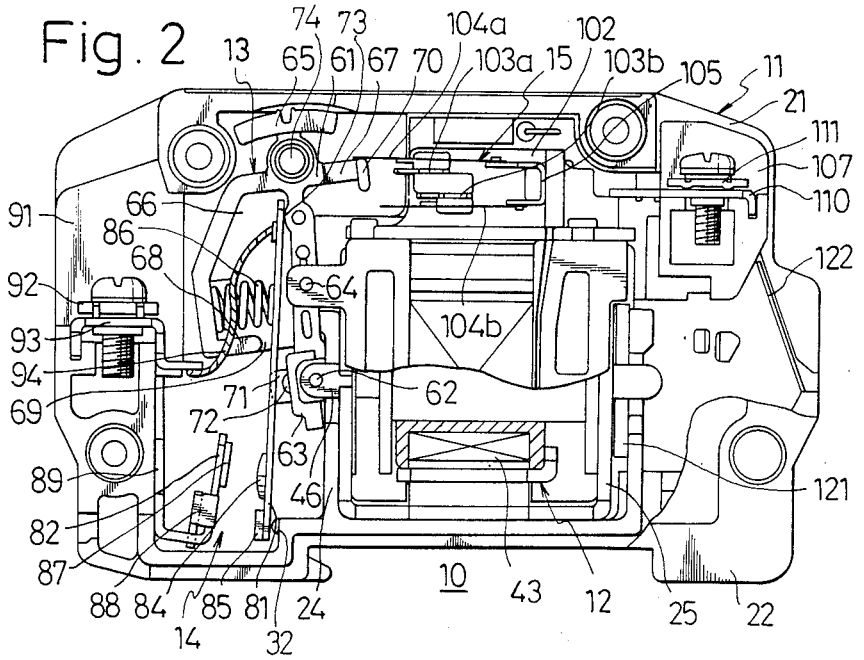
FIG. 2 is a similar side elevation to FIG. 1 of the relay in its contact opening state.

The switching-contact operation means 13 include, as seen in FIGS. 1, 2 and 5, a rocker 61 generally T-shaped, which is provided at its lower portion with a linkage part 63 for receiving the tip end of the movable projection 46 of the movable core 44 projected out of the electromagnet means 12 and for pivotal connection of the rocker to the movable projection 46 by means of a pin 62, while the rocker 61 is pivotably supported at an intermediate position of vertically extending body by a pivot pin 64 passed through the pin holes in the horizontal projections 54*a* and 54*b* of the coil frame 41 and a hole in the rocker. At the upper end extended beyond the pivot pin 64, the rocker 61 has an arcuate-surfaced indicating part 65 opposed to the indicating aperture 29 in the top wall of the body 21. Further at a position spaced slightly downward from the indicating part 65 but remote from the pivot pin 64, a backward extended actuating arm 67 and a forward expanded small holding chamber 66 are provided to the rocker 61, and this small holding chamber 66 is made to further expand downwardly beyond the position of the pivot pin 64 and to be opened on one side but closed on the other side. A lower end wall 68 of the holding chamber 66 is partly removed on the side of the vertically extending body to define an opening 69. The actuating arm 67 has a free end 70 which extends slightly downward and also horizontally in a direction perpendicular to the backward extending direction of the arm (to the plane of the drawing figures). In addition, the rocker 61 is provided, on forward side of the linkage part 63, with an engaging extrusion 71 substantially in the center of width direction of the part 63 and, on both sides of the extrusion 71, with raised portions 72 (only one of which is seen in the drawings) smaller in height than the extrusion 71.

The main switching contact means 14 includes a movable contactor 81 and a stationary contactor 82. The movable contactor 81 is provided substantially in the center with a supporting hole 83 for engaging therein the engaging extrusion 71 at the linkage part 63 of the rocker 61, and carries on the forward side of the lower end part a movable contact 84 and an electromagnetic iron piece 85, the other backward side of the lower end part being engageable with a forward projection 32 provided on the bottom side peripheral wall of the smaller compartment 26. The movable contactor 81 is mounted to the rocker 61, disposing the upper part above the supporting hole 83 within the small holding chamber 66 to be biased backward by a compression spring 86 provided on the forward side inner wall of the chamber 66. The fixed contactor 82 is provided, at its one end backward and upward bent in the smaller compartment 26, with a fixed contact 87 with which the movable contact 84 is contactable and, at a position immediately below the fixed contact 87, with an electromagnetic iron piece 88 to which the electromagnetic iron piece 85 of the movable contactor 81 is opposable.

It will be appreciated that, with the foregoing arrangement, the movable projection 46 of the electromagnet means 12 extends from the larger compartment 23 beyond the partition 24 into the smaller compartment 26 in which the contact operating means 13 including the rocker 61 pivotably linked to the movable projection 46 as well as the main switching contact means 14 linked to the operating means 13 are housed.

The fixed contactor 82 in the main switching contact means 14 is integrally provided with a fixed terminal plate 89 which extends upwardly along the inner surface of one end wall of the body 21 to be connected to a fixed-terminal metal fitting 90 mounted in the terminal mounting part 27 of the body 21. Also in the terminal mounting part 27, a partitioning plate 91 and a movable-terminal metal fitting 92 electrically connected to the movable contactor 81 through a movable-terminal plate 93 and a braided-wire conductor 94 are provided.

The auxiliary contact means 15 is accommodated within the space in the larger compartment 23 left above the electromagnet means 12, and comprises a supporting plate 101 which has at its four corners notches in which the upward projections 53*a* to 53*d* of the coil frame 41 in the electromagnet means 12 are engageable for mounting the plate 101 onto the electromagnet means 12 as fixed, if necessary, by bonding. The supportng plate 101 is formed to have a centrally erected wall 102 for mounting to one side face thereof a pair of auxiliary fixed contact springs 103*a* and 103*b* as mutually vertically spaced and an auxiliary movable contact plate 105 having auxiliary movable contact springs 104*a* and 104*b* which are parallelly extended as also mutually vertically spaced, so that the fixed contact springs 103*a* and 103*b* will oppose respectively each of the movable contact springs 104*a* and 104*b*, the latter of which are further extended to be above and below the free end 70 of the actuating arm 67 of the rocker 61 to be thereby alternately actuated. Laterally extended ends of the auxiliary fixed contact springs 103*a* and 103*b* as well as a laterally extended end 105*a* of the auxiliary movable contact plate 105 are arranged to extend through the erected wall 102 to the other side thereof, on which the other side a printed circuit board 106 carrying thereon certain of circuit parts for the circuit of FIGS. 8 and 9 detailed later is provided, as electrically connected at its predetermined positions to the respective laterally extended ends of the auxiliary fixed contact springs 103*a* and 103*b* and movable contact plate 105.

The supporting plate 101 is so formed, at its backward side end, as to extend through the partition 25 into the outer endwise opened space of the body 21 to occupy the upper part of the space, and as to have an upward erected position 107 and a horizontal terminal mounting plate 107*a*, the position 107 being positioned in the middle of the upper space part and the plate 107*a* lying on both sides of the partition 107. Two sets of auxiliary terminal plate and terminal metal-fitting 108, 109 and 110, 111 are respectively provided on each side of the partition 107, while the set of 108, 109 is electrically connected to one end of the coil 43 of the electromagnet means 12 and another set of 110, 111 is connected at an extended end 110*a* of the terminal plate 110 to the printed circuit board 106 at one of the predetermined positions. The other end of the coil 43 of the electromagnet means 12 is electrically connected to the auxiliary movable contact plate 105.

A buffer spring 121 is provided between the backward end face of the electromagnet means 12 and the inner surface of the partition 25 of the body 21 to have the electromagnet means 12 stably positioned within the larger compartment 23. A remaining lower part of the outer endwise open space on the other side of the partition 25 is closed by a blind plate 122. While not shown, it may be possible to provide in the remaining lower space part, instead of closing it by the plate 122, such a switch that detects operating states of the electromagnet means 12 as actuated by the pushing projection 47 of the movable core 44.

Now the operation of the remotely controllable relay 10 according to the present invention shall be explained. As will be understood, FIG. 1 shows a state of the relay in ehich the main switching contact means 14 connected to a load circuit is closed, whereas FIG. 2 shows a state in which the means 14 is opened.

When the relay is in either state of FIG. 1 or 2 and the electromagnet means 12 is not excited, the magnetic force of the permanent magnets 51*a* and 51*b* in the electromagnet means 12 is acting on either one of the backward side and forward side armatures 48*b* and 48*a* through the smaller yokes 50*a* and 50*b* so that the backward side armature 48*b* is attracted to these yokes 50*a* and 50*b* (the state shown in FIG. 6) or the forward side armature 48*a* is attracted thereto (the state shown in FIG. 7). In this case, as shown by a curve MF in FIG. 10, the attractive magnetic force of the permanent magnets 51*a* and 51*b* becomes larger as the full contact opened or closed state approaches. During contact opening operation, the spring 86 biasing the movable contactor is compressed as in FIG. 2 to apply such a spring load as shown by a sharply bent curve SFF in FIG. 10, but the attractive magnetic force of the permanent magnets 51*a* and 51*b* overcomes this spring load, so that the movable core 44, rocker 61 and movable contactor 81 are stably maintained at either one of their contact closed or opened state.

Figure 10:
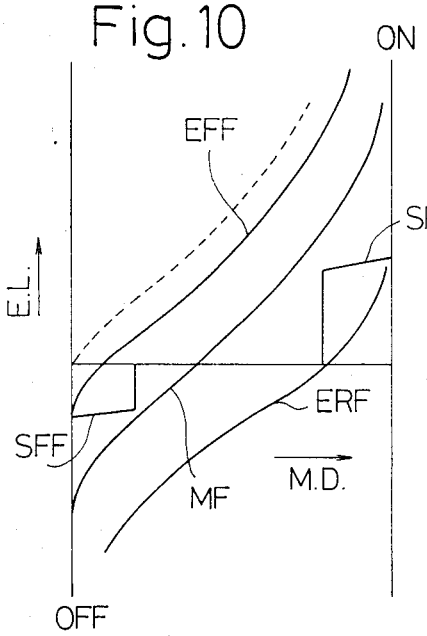
FIG. 10 shows diagramatically relationship of the displacement MD of the movable core to electromagnetic attraction force and load E.L. applied to the core in the relay of FIG. 1.

When the movable core 44 is at its backward retreated position of opening the contacts as in FIG. 2 and a current is fed to the coil in a predetermined direction, the movable core 44 is caused to move forward from the state of FIG. 7 to that of FIG. 6. That is, in the state of FIG. 7 where, as shown therein as an example, the permanent magnets 51*a* and 51*b* are disposing their N-poles against the smaller yokes 50*a* and 50*b*, a current fed to the coil 43 in a direction of magnetizing the forward side armature 48*a* to be N-pole will cause an electromagnet force larger than the magnetic force MF of the permanent magnets 51*a* and 51*b* as shown by the curve EFF in FIG. 10 to be generated, and an electromagnet repulsive force is thereby caused to occur between the forward side end edges of the smaller yokes 50*a* and 50*b* and the forward side armature 48*a*. Since the U-shaped yokes 49*a* and 49*b* abut against the S-pole surfaces of the permanent magnets 51*a* and 51*b* and are magnetized to be S-pole, the yokes 49*a* and 49*b* act to attract the N-polarized armature 48*a*, to which attraction the biasing spring load shown by the sharply bent curve SRF in FIG. 10 is added upon contact closing operation. Consequently, the movable core 44 is moved forward from the position of FIG. 7 to that of FIG. 6 where the movable core 44 is attracted to the inner surfaces of the forward side ends of the yokes 49*a* and 49*b* as spaced therefrom by a distance corresponding to the thickness of the residual plate 52*a*, moving thus the movable projection 46 of the core 44 from the retreated position of FIGS. 2 and 7 to the forward moved position of FIGS. 1 and 6.

Figure 11:
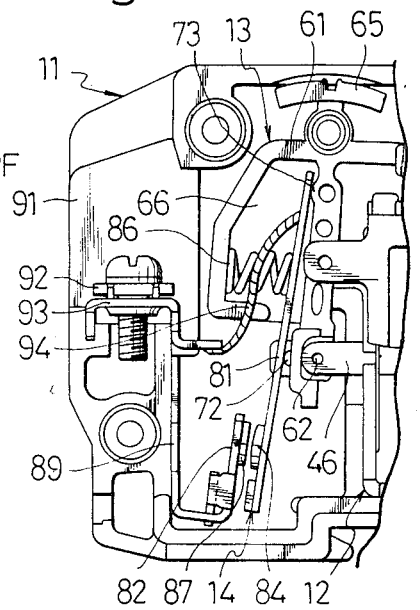
FIG. 11 is a fragmental side view of the relay of FIG. 1 for explaining the operational relation specifically between the rocker, contact springs and movable contactor.

As the movable projection 46 is thus moved, the lower part of the rocker 61 of the contact operating means 13 is thereby moved forward, and thus the rocker 61 rocks clockwise in the drawings about the pivot pin 64 as a fulcrum. At the same time, the movable contactor 81 of the main contact means 14 linked through the projection 71 to the rocker 61 is also caused to rotate about the projection 71 in the same direction as the rocker, due to the biasing force of the spring 86. Because this rotation of the movable contactor 81 starts from the position where the lower end of the contactor 81 abuts against the supporting projection 32 provided on the front face of the base of the smaller partition 26, that is, from a position in which the movable contact 81 is preliminarily advanced in the clockwise direction, the necessary electromagnetic force for starting the rotation can be reduced. Provided that the supporting projection 32 is absent, such a relatively high electromagnetic force as shown by a dotted-line curve in FIG. 10 is required to drive the movable core 44. According to the foregoing arrangement, however, the movable core 44 can be driven with such a relatively low electromagnetic force as shown by the curve EFF. That is, during contact closing operation, as shown in FIG. 11, the movable contactor 81 is resiliently biased to abut at its central part against the supporting projections 72 on both sides of the engaging projection 71 of the rocker 61 and also at its upper part against the upper part of the rocker 61, preferably, at its projection 73 formed thereon to be above the pivot pin 64, so that the projection 46 of the movable core 44 will receive substantially no reverse biasing force of the spring 86 during the forward motion of the movable core 44, as will be clear from FIG. 10. When the movable contactor 81 has reached the contact closed state of FIGS. 1 and 6, the contactor 81 engages its movable contact 84 with the fixed contact 87 of the fixed contactor 82, as so biased by the spring 86. That is, as the movable projection 46 further moves forward, the upper part of the rocker 61 rotates to separate from the upper part of the movable contactor 81, as seen in FIG. 1, whereupon the biasing force of the spring 86 is fully activated to rotate the movable contactor 81 clockwise about the projections 72 on the rocker 61 as the fulcrum, providing thus effectively a contacting pressure to the both contacts 84 and 87. With such an arrangement, the contactor-biasing spring 86 can provide the effective contacting pressure, substantially without any adverse action on the forward motion of the movable core 44, so that the main contact means 14 can be actuated to close the contacts with a lower electromagnetic force and, in this respect, too, the required electromagnetic force can be reduced.

Figure 8:
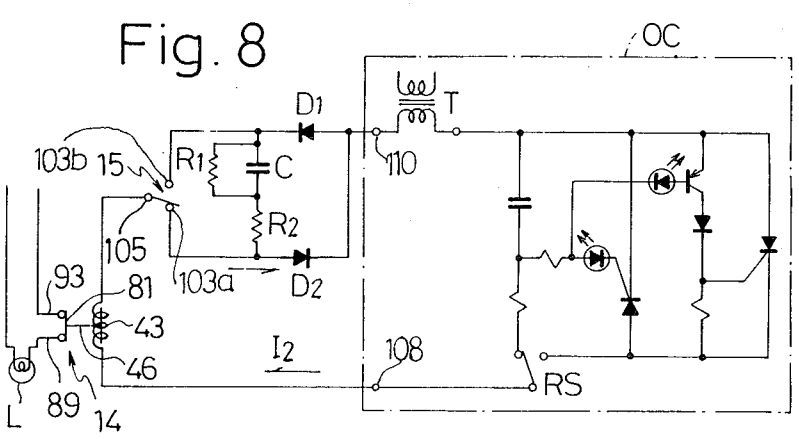
FIG. 8 shows an example of a power supply circuit applicable to the relay of FIG. 1, with the circuit shown in its contact closing state.
Figure 9:
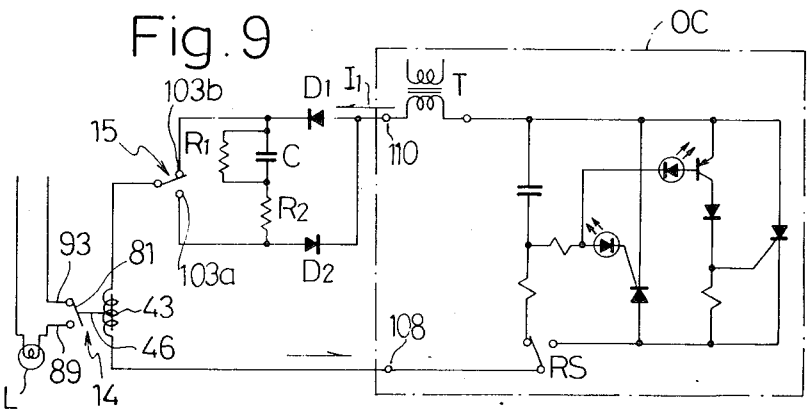
FIG. 9 shows the circuit of FIG. 8 in its contact opening state.

Energization of the coil 43 of the electromagnet means 12 is carried out by means of the power supply circuit of FIGS. 8 and 9 through the auxiliary contact means 15. In the illustrated embodiment, the power supply circuit comprises an operating circuit OC including a transformer T for reducing a power source voltage normally to 24 V, and a remote control switch RS. When a current flows in a direction shown by an arrow $I_1$ as in FIG. 9 from the operating circuit OC in response to an actuation of the remote control switch RS in the operating circuit OC, a direct current will flow through the auxiliary terminal plate 110, a diode $D_1$ incorporated in the printed circuit board 106, auxiliary fixed contact spring 103*b*, auxiliary movable contact plate 105, coil 43 and auxiliary terminal plate 108, whereby the forward side armature 48*a* is magnetized to be N-pole. In this case, a series circuit of a parallel circuit of a resistor $R_1$ and capacitor C and of a resistor $R_2$ and connected between the pair of auxiliary fixed contact springs 103*a* and 103*b*, as incorporated in the printed circuit board 106, absorbs any surge voltage to thereby prevent any malfunction.

Upon the energization of the coil 43 of the electromagnet means 12 for closing the main switching contact means 14 seen in FIG. 1, the clockwise rocking of the rocker 61 causes the free end 70 of the actuating arm 67 to rotate downwardly backward, the auxiliary movable contact spring 104*a* of the auxiliary movable contact plate 105 and disposed above the free end 70 is thereby released form the free end 70 so as to come into contact with the opposing auxiliary fixed contact spring 103*a*, while the other auxiliary movable contact spring 104*b* is hit be the rotated free end 70 to be separated from the opposing auxiliary fixed contact spring 103*b*. In this arrangement, the free end 70 of the actuating arm 67 is made to act on the tip end of the respective auxiliary movable contact springs which are provided with a relatively high resiliency, and the contact switching time of the auxiliary movable contact springs 104*a* and 104*b* with respect to the auxiliary fixed contact springs 103*a* and 103*b* is thereby caused to be somewhat delayed from the closing time of the main switching contact means 14. Accordingly, the energization of the coil 43 will be continued for a short time after the closing of the main switching contact means 14 so that the movable core 44 can be sufficiently driven until the movable contactor 81 positively shifts to the closed position. While the use of such auxiliary contact means 15 enables it possible to ensure the reliable operation of the movable core 44, it is also made possible to operate the core in a relatively short time and thus to remarkably reduce the consumed power.

Figure 12:
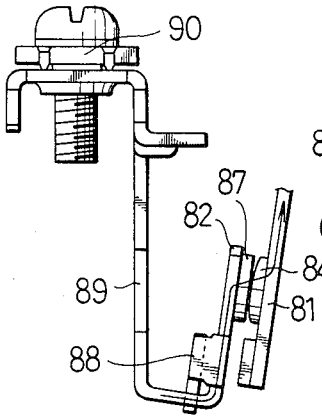
FIGS. 12 to 14 are side views of movable and fixed contacts in the relay of FIG. 1 respectively with a part of them removed for explaining the operational relation between them.
Figure 13:
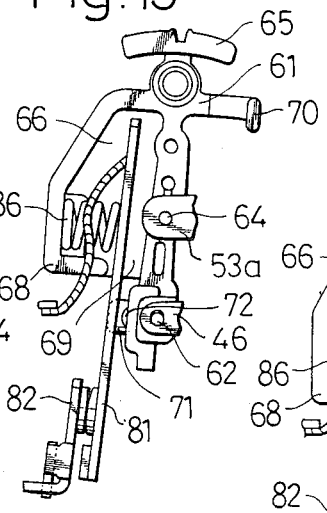

An ocurrence of such a large short-circuit current as to be, for example, above 1500 A in the closed state as has been described of the main switching contact means 14 may happen to cause the means to be forcibly opened due to an electromagnetic repulsive force generated heretofore between the movable and fixed contactors 81 and 82. According to the present invention, however, such forcible contact opening even upon a larger current of specifically more than 2500 A can be prevented. That is, as shown in FIG. 12, a flow of the short-circuit current in a direction shown by an arrow from the fixed contactor 82 to the movable contactor 81 causes an electromagnetic force to be produced in the electromagnetic iron piece 88 at the base of the fixed contactor 82, and this electromagnetic force acts to attract the electromagnetic iron piece 85 at the lower end of the movable contactor 81. Futher, as the fixed terminal plate 89 is bent into an L-shape to just shortly extend upward on the bottom wall of the body 21 and to oppose only the lower end portion of the movable contactor 81, it is made possible to minimize effectively the extent of opposite directional flow of the current through the opposing portions of the both contactors 81 and 82 to prevent enough generation of the electromagnetic repulsive force for the forcible opening of the contacts.

In switching over the main contact means 14 from the closed state of FIG. 1 to the opened state of FIG. 2, a current is fed to the coil 43 in the opposite direction to that in closing the means, such as shown by an arrow $I_2$ in FIG. 8, whereupon a direct current flows through the auxiliary terminal plate 108, coil 43, auxiliary movable contactt plate 105, auxiliary fixed contact spring 103*a*, a diode $D_2$ incorporated in the printed circuit board 106, and auxiliary terminal plate 110 to generate such an electromagnetic force larger than the magnetic force MF of the permanent magnets 51*a* and 51*b* as shown by a curve ERF in FIG. 10. The backward side armature 48*b* is magnetized through the yokes 50*a* and 50*b* to be, for example, N-pole as shown in FIG. 6, and the movable core 44 is driven backward to retreat from the position of FIG. 6 to that of FIG. 7 where the backward side armature 48*b* is attracted to the backward side ends of the yokes 49*a* and 49*b* as spaced therefrom by the thickness of the residual plate 52*b*, with the movable projection 46 of the core likewise backward retreated.

Accompanying the backward retraction of the movable projection 46, the rocker 61 linked thereto is rotated counterclockwise in the drawings so that the switching-contact operating means 13, main switching contact means 14 and auxiliary contact means 15 are all actuated substantially in opposite manner to the foregoing case of closing the main switching contact means 14, and the closed state of FIG. 2 is reached from the opened state of FIG. 1.

Figure 14:
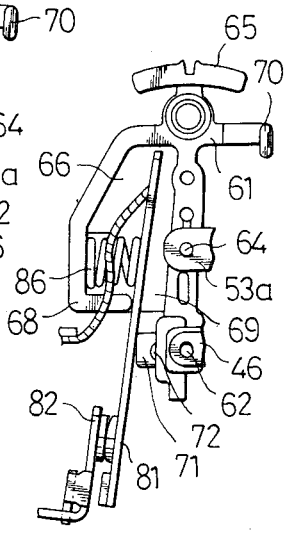

In an event where the contact opening operation is confronted with a fusion bonding between the movable and fixed contacts 84 and 87 of the both contactors 81 and 82 due to any large current, there will be produced according to the present invention a force acting positively to separate the movable contact 84 from the fixed contact 87. That is, in the opening operation of the main switching contact means 14, such fusion bonding took place between the movable and fixed contacts 84 and 87 causes the lower end of the movable contactor 81 not to separate from the fixed contact 87 upon starting of the backward motion of movable projection 46 and even when the supporting projections 72 of the thus rotated rocker 61 separate from the movable contactor 81. During this rocking motion of the rocker 61, on the other hand, the projection 73 at the upper part of the rocker comes into engagement with the upper end of the movable contactor 81 counterclockwise so as to compress the spring 86 through the contactor 81, and the thus compressed spring 86 acts on the contactor 81 with the projection 73 as the fulcrum to urge the contactor 81 to separate from the fixed contact 82. Even when the separation is still not achieved by the spring 86, the rocker 61 keeping to rock counterclockwise causes the backward end edge of the lower wall 68 defining the small holding chamber 66 of the rocker 61 to hit upon the forward side surface of the movable contactor 81 as shown in FIG. 14 so as to provide a backward force to the contactor 81 in addition of the biasing force of the spring 86, whereby the lower end of the movable contactor 81 is forcibly separated from the fixed contactor 82, so that the fusion bonded contacts 84 and 87 can be ensured to be reliably separated.

In the remote controllable relay of the present invention, further, the top indicating part 65 of the rocker 61 is opposed to the top wall aperture 29 of the body 21 as has been disclosed, for indicating ON and OFF states of the relay depending on the rocked positions of the rocker 61. Taking the advantage of this arrangement, it is possible to externally operate the contact means 14 by manually operating the indicating part 65 through the aperture 29.

In the foregoing relay 10, in addition to that the electromagnet means 12 is assembled into a block, it will be appreciated that the operating means 13, movable contactor 81 and auxiliary contact means 15 can be also easily assembled into a block, so as to remarkably improve the assembling ability of the entire relay construction.

Figure 15:
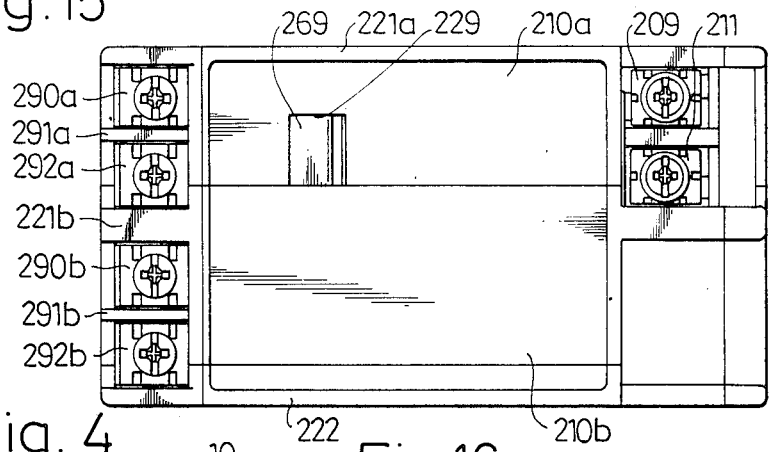
FIG. 15 is a top plan view in another embodiment of the remotely controllable relay according to the present invention.
Figure 4:
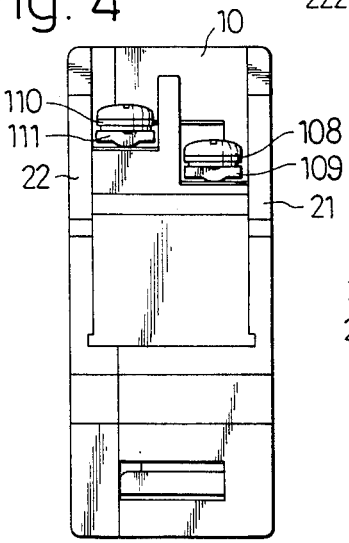
FIG. 4 is an end view of the relay of FIG. 1.
Figure 16:
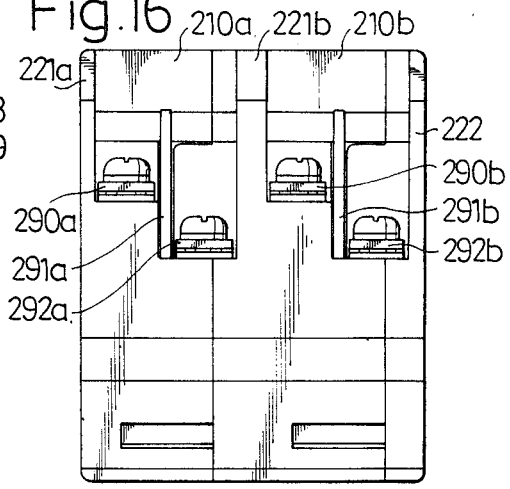
FIG. 16 is an end view of the relay of FIG. 15.

In another aspect of the present invention, a plurality of the remotely controllable relays are assembled into a single relay unit, so that a number of loads can be integrally, concentratively controlled. Referring to FIGS. 15 and 16, an example in which the relay unit comprises two relays 210*a* and 210*b* is shown. The first relay 210*a* is substantially of the same arrangement as the relay 10 that has been disclosed with reference to FIGS. 1 to 14, and is joined with the second relay 210*b* in a state of omitting the covering 22 of the relay 10. The second relay 210*b* comprises only the switch operating means 13 and main switching contact means 14 in the relay 10 of FIGS. 1 to 14. While not shown, a linking shaft is secured to a linking part 74 of the rocker 61 (FIG. 5) in the switch operating means 13 of each of the first and second relays 210*a* and 210*b* so as to extend across the both relays, so that the rocker in the second relay 210*b* will be interlocked with the rocker 61 in the first relay 210*a* and the respective main switching contact means 14 of the first and second relays 210*a* and 210*b* can be simultaneously operated through the linking shaft, whereby the power source circuits connected to the plurality of loads can be turned ON and OFF simultaneously. Though the two relays 210*a* and 210*b* have been shown as employed in the arrangement of FIGS. 15 and 16, a plurality of the relays of the same arrangement as the second relay unit 210*b* may be used to form a single relay unit, in which event the final stage relay is covered by a covering 222 similar to the covering 22 in the foregoing embodiment, and an elongated linking shaft is used to integralize the plurality of the relays into a single relay unit.

What is claimed as our invention is:

1. A remotely controllable relay comprising an electromagnet means having a coil arranged for feeding thereto an energizing current in opposite directions and a movable member coupled to a core reciprocatingly movable along the axial directions of said coil, said movable member being a movable projection integral with said movable core for forward and backward motion therewith on one side of said electromagnet means in said axial direction of said coil; a rocker, pivotally supported to a coil frame of said electromagnetic means and pivotally connected to said moveable projection of said moveable core at one end portion remote from said pivotally, supported position, linked to said movable member to be rocked forward and backward in response to said reciprocating movement of said core; a movable contactor electrically connected to a load and linked to said rocker for following said rocking of said rocker, and a fixed contactor electrically connected to said load, said rocker, movable, and fixed contactors being disposed on one side of the electromagnet means, said movable contactor following the rocking of the rocker; an auxiliary contact means actuable with said rocking of said rocker for cutting said current fed to said electromagnetic means, said rocker forming part of a switching-contact operator means which includes a small holding chamber provided on one side of said rocker opposite to said coil frame, said chamber including an opening for passing therethrough said movable contactor, and a biasing spring disposed in said chamber for providing to said movable contactor a contacting pressure with respect to said fixed contactor and said movable member being shifted in one of said axial direction of the coil in reponse to said current feeding direction to said electromagnet means to turn ON and OFF as associated power source circuit for said load.

2. A relay according to claim 1, which further comprises a casing defining therein a larger compartment for housing said electromagnet means and a smaller compartment housing said switching-contact operating means and main switching contact means, said casing having a projection for supporting said movable contactor operated to separate from said fixed contactor at a position diviated toward the fixed contactor from a completely separated position following said movable projection.

3. A relay according to claim 2, wherein said auxiliary contact means is disposed in said larger compartment with said electromagnet means to be operated by said rocker rocked for cutting said current fed to said electromagnet means.

4. A relay according to claim 2, which further comprises a switch provided in said casing on the side opposite to said smaller compartment for detecting the operating state of said main switching contact means, said switch being actuatable through a pushing projection integrally provided to said movable core opposite to said movable projection in response to said reciprocating movement of the core.

5. A relay according to claim 1, wherein said fixed contactor is provided to be partly opposed to a limited, opposed part of said movable contactor, and said opposing parts of said fixed and movable contactors form respectively a means for electromagnetically attracting each other.

6. A relay according to claim 1, which further comprises at least an associated relay comprising only components forming said switching-contact operating means and main switching contact means, a rocker in said operating means of said associated relay being interlocked to said rocker of said relay for simultaneous rocking therewith.

* * * * *